US006607518B1

(12) United States Patent
Hazeleger

(10) Patent No.: US 6,607,518 B1
(45) Date of Patent: Aug. 19, 2003

(54) ASSEMBLY AND METHOD FOR PENETRATING THE UTERUS OF AN ANIMAL DURING A NON-SURGICAL PROCEDURE

(75) Inventor: Wouter Hazeleger, Veendendaal (NL)

(73) Assignees: Institute for Pig Genetics B.V., Beuningen (NL); Nutreco Nederland B.V., Boxmeer (NL); Dalland B.V., Vught (NL)

( * ) Notice: Subject to any disclaimer, the term of this patent is extended or adjusted under 35 U.S.C. 154(b) by 156 days.

(21) Appl. No.: 09/586,126

(22) Filed: Jun. 2, 2000

Related U.S. Application Data

(63) Continuation of application No. PCT/NL98/00689, filed on Dec. 4, 1998.

(30) Foreign Application Priority Data

Dec. 4, 1997 (EP) ..... 97203804

(51) Int. Cl.[7] ..... A61D 19/04; A61D 19/02

(52) U.S. Cl. ..... 604/515; 604/164.01; 604/187; 604/197; 604/906

(58) Field of Search ..... 604/164.01, 187, 604/197, 515, 906

(56) References Cited

U.S. PATENT DOCUMENTS 4,457,313 A * 7/1984 Alter ..... 600/562
5,147,315 A * 9/1992 Weber ..... 600/35
5,195,979 A * 3/1993 Schinkel et al. ..... 604/164.09
5,364,375 A * 11/1994 Swor ..... 128/841
5,389,089 A * 2/1995 Bauer et al. ..... 600/35
5,472,419 A * 12/1995 Bacich ..... 600/35
5,496,272 A 3/1996 Chung et al.
6,139,538 A * 10/2000 Houghton et al. ..... 604/21

FOREIGN PATENT DOCUMENTS

| | | |
|---|---|---|
| FR | 2 432 866 | 3/1980 |
| FR | 2 450 102 | 9/1980 |
| FR | 2 477 008 | 9/1981 |
| WO | WO 96/35384 | 11/1996 |
| WO | WO 99/27868 | 6/1999 |

OTHER PUBLICATIONS

PCT International Search Report, PCT/NL98/00689, dated Sep. 3, 1999, 2 pages, listing the above–identified documents.

PCT International Preliminary Examination Report, PCT/NL98/00689, dated Mar. 3, 2000, 8 pages.

* cited by examiner

*Primary Examiner*—J. Casimer Jacyna
(74) *Attorney, Agent, or Firm*—TraskBritt

(57) ABSTRACT

An assembly for penetrating the uterus of an animal during a non-surgical procedure comprising a probe having an elongated body with a longitudinal axis and a probing member extending at least laterally outwardly at the forward end of the probe body, a channel extending between an inlet opening at a distance from the probing member and an outlet opening near the probing member, wherein the channel comprises at least one bend or curve, such that the axis of the channel near the outlet opening encloses an angle different from 180° with the longitudinal axis of the probe body, the probe being adapted to be inserted, forward end first, inside the cervix of the animal, and manipulatable to gently maneuver the probing member in a forward direction through the cervix to a position in which the probing member and the outlet opening are within or adjacent the body of the uterus.

20 Claims, 6 Drawing Sheets

ASSEMBLY AND METHOD FOR PENETRATING THE UTERUS OF AN ANIMAL DURING A NON-SURGICAL PROCEDURE

RELATED APPLICATIONS

This application is a continuation under 35-U.S.C. §§120 and 365(c) of pending International Patent Application PCT/NL98/00689 filed on Dec. 4, 1998, and designating the United States of America. International Patent Application PCT/NL98/00689 claims priority from European Patent Application EP 97203804.6 filed on Dec. 4, 1997, and was published Jun. 10, 1999, as International Publication WO 99/27868, the contents of which are incorporated herein by this reference.

TECHNICAL FIELD

Invention relates to an assembly for penetrating the uterus of an animal during a non-surgical procedure, especially for the introduction of material such as embryos into the uterus of an animal. Such an assembly is known from international publication WO 96/35384.

BACKGROUND

The known assembly comprises a rigid metal probe, having a long tubular body with a central longitudinal axis and a probing member curving forwardly and laterally outwardly, substantially beyond the forward end of the probe body, the probe body having open forward and rearward ends. The probe is adapted to be inserted, forward and first, inside the cervix of the animal, the probe body then being manipulatable to gently maneuver the probing member in a forward direction through the cervix to a position in which the probing member and the forward open end of the probe body are adjacent the body of the uterus. For introduction of the probe into the cervix, a long tubular gripping instrument is provided, having an open forward end and an external formation configured for gripping the walls of the cervix when the instrument is inserted. The gripping instrument has to be pulled in a rearward direction to straighten the cervix to be able to introduce the probe. The probe body is sized for a coaxial insertion inside the gripping instrument from the forward end thereof, such that the rearward end of the probe body extends outside the rearward end of the gripping instrument. When the probing member is brought into the position adjacent the body of the uterus, as tested with a stainless steel detecting bar, a fluid carrier can be inserted through the probe body, into a position wherein the front end of the elongated fluid carrier extends in a longitudinal direction from the forward, open end of the probe body into the uterus body. Fluid containing the embryos or semen can then be expelled from the fluid carrier into the uterus body.

This known assembly has the disadvantage that it is complex, both in composition as well as in use. The assembly comprises a large number of separate parts to be positioned inside and maneuvered relative to each other, which can be difficult, time consuming and irritating for the animal, which will be detrimental to the result. Therefore, the animals have to be anaesthetized especially for enabling positioning of the animal on its back before introduction of the instrument. Furthermore, due to the rigidity of the probe and probe member and the fact that the probe member has to be introduced into the forward end of the gripping instrument, such that the probing member is enclosed within the soft, cork-screw-like forward part of the gripping member, whereby the rearward end of the probe body extends far outside the rearward end of the gripping member, this known assembly is difficult to maneuver. Furthermore, since the probe body is tubular, having open forward and rearward ends, the channel extending through the probe body can easily be contaminated with material from the vagina, cervix and/or uterus, prior to introduction of the fluid carrier into the channel. This can easily result in contamination of the fluid within the fluid carrier, thus influencing the result of the procedure negatively. Moreover, since the channel extends longitudinal through the probe body, the fluid carrier will depart from the probe body in the longitudinal direction of the probe body, and will thus be driven directly into the wall thereof, perpendicular to the longitudinal direction of the cervix. This can be irritating and hazardous for the animal and can furthermore result in further contamination of the fluid. Upon further introduction of the fluid carrier, the forward end, extending outside the probe body, will bend and will be pushed into one of the horns of the uterus, which could result in a fold in the fluid carrier, resulting in a blockage of the through bore of the fluid carrier, thus preventing or at least hindering the delivery of the fluid into the uterus body and cause lethal damage to the fragile embryos due to squeezing.

FR-A-2477008 and FR-A-2432866 both disclose further assemblies for penetrating the uterus of an animal. These known assemblies both comprise a rigid tubular probe member, made of metal, which during use extends straight through the uterus and cervix, forcing apart any curved wall parts. Therefore, these probe members cannot be used with unsedated animals.

SUMMARY OF THE INVENTION

A main object of the present invention is to provide for an assembly for penetrating the uterus of an animal during a non-surgical procedure, wherein the drawbacks of the known method are overcome, maintaining the advantages thereof An assembly according to the present invention comprises only a limited number of components, which are easy to manufacture and use, wherein the probe body can be introduced into the cervix of the animal directly, via the vagina, and can then be manipulated such that the probing member passes the cervix to a position within or adjacent the uterus body. Since the axis of the outlet opening encloses an angle with the longitudinal axis of the probe body, accumulation of contamination within the channel can be easily prevented, whereas blockage of the outlet opening by the wall of the uterus body, when the probe body is fully inserted, is easily prevented. An assembly according to the present invention provides for easy and safe penetration of the uterus of an animal during a non-surgical procedure, whereby the outlet opening of the channel and thus the place of introduction of, for example, embryos or semen is accurately reproducible. Thus, the chances of success of a non-surgical procedure performed with an assembly according to the present invention are very high. Thereby, the animals do not have to be anaesthetized or restrained to perform the procedure, but can be housed similar as when performing usual artificial inseminations.

At least part of the inside walls of the cervical channel is convoluted and lined with rounded prominences, some of which dovetail, occluding the canal. With an assembly according to the present invention, the probe being sufficiently flexible, the probe can be introduced into the cervix and manipulated such that the probing member can be maneuvered in between the prominences, partly pushing these apart, whereby the probe body can follow the curves of the cervical canal and at least partly follow the convolution of the inner walls by flexing, thereby passing the occlusions of the canal. The outlet opening of the channel can thus be brought easily, conveniently and accurately within or adjacent the uterus body.

In a further advantageous embodiment, an assembly according to the present invention is characterized by a second tubular member, being slidably insertable through the channel. This second tubular member can be easily used as a fluid carrier. Since the length of the second tubular member is greater than the length of the channel, the forward end of the second tubular member, provided with an outlet opening, can be pushed through the outlet opening of the channel by manipulating a rearward part of the second tubular member still extending outside the channel from the inlet opening thereof. In combination with the axis of the outlet opening of the channel enclosing an angle with the longitudinal axis of the probe body, the direction of extension of the forward end of the second tubular member through the outlet opening of the channel will be advantageous since the forward end of the second tubular member will not be driven directly into the inside wall of the uterus body but into one of the horn-like protrusions of the uterus body. Thus, blockage of the outlet openings is easily prevented. Furthermore, the tubular member can be introduced from the rearward end of the channel, after the probe body has been fully introduced.

By providing a tubular member extending along at least part of the probe body and the probing member, the channel can be easily provided. The tubular member can be attached to the probe body, at least near the probing member, for example, by adhesive or a mutual relatively soft and flexible coating, whereas the rearward end of the probe body and the tubular member can be separated. The rearward end of the tubular member can then be easily manipulated for introduction of, for example, a fluid carrier, a cannula or the needle of a syringe, without having to grip the rearward end of the probe body and vice versa.

In an alternative embodiment, an assembly according to the present invention features a channel which extends through the probe body and the probing member, the assembly thus being very easy to manufacture, for example, by bending from an elongated tubular piping.

In further elaboration, an assembly according to the present invention may be characterized by providing the outlet opening in the wall of the second tubular member, the forward end of the tubular member, being closed, provides for an advantageous direction for expelling fluid from the outlet opening, approximately perpendicular to the longitudinal direction of the tubular member, thereby even better preventing blockage of the outlet opening of the second tubular member should the forward end thereof be driven into the inner wall of the uterus body. Since the forward end of the second tubular member, extending from the channel within the uterus body, will be approximately straight, that is not bent over 180° or more, as the fluid carrier used with the known assembly, folding thereof is easily prevented, thus preventing occlusion of the channel within the second tubular member.

The invention further relates to a method for non-surgical introduction of material such as embryos into the uterus of an animal. Such method necessitates only the use of a probe with an elongated channel and a tubular member slidably insertable into the channel. A method according to the present invention can easily and very accurately be performed with a very high rate success. Such method is very animal friendly, quick and relatively inexpensive.

Further advantageous embodiments of an assembly and a method according to the present invention are described in the subclaims and the description.

To further clarify the invention, exemplary embodiments of a method and assembly according to the present invention will be described hereafter with reference to the drawings.

DESCRIPTION OF THE SEVERAL VIEWS OF THE DRAWINGS

Corresponding parts are designated by corresponding reference numbers throughout the description.

DETAILED DESCRIPTION

Figure 1:
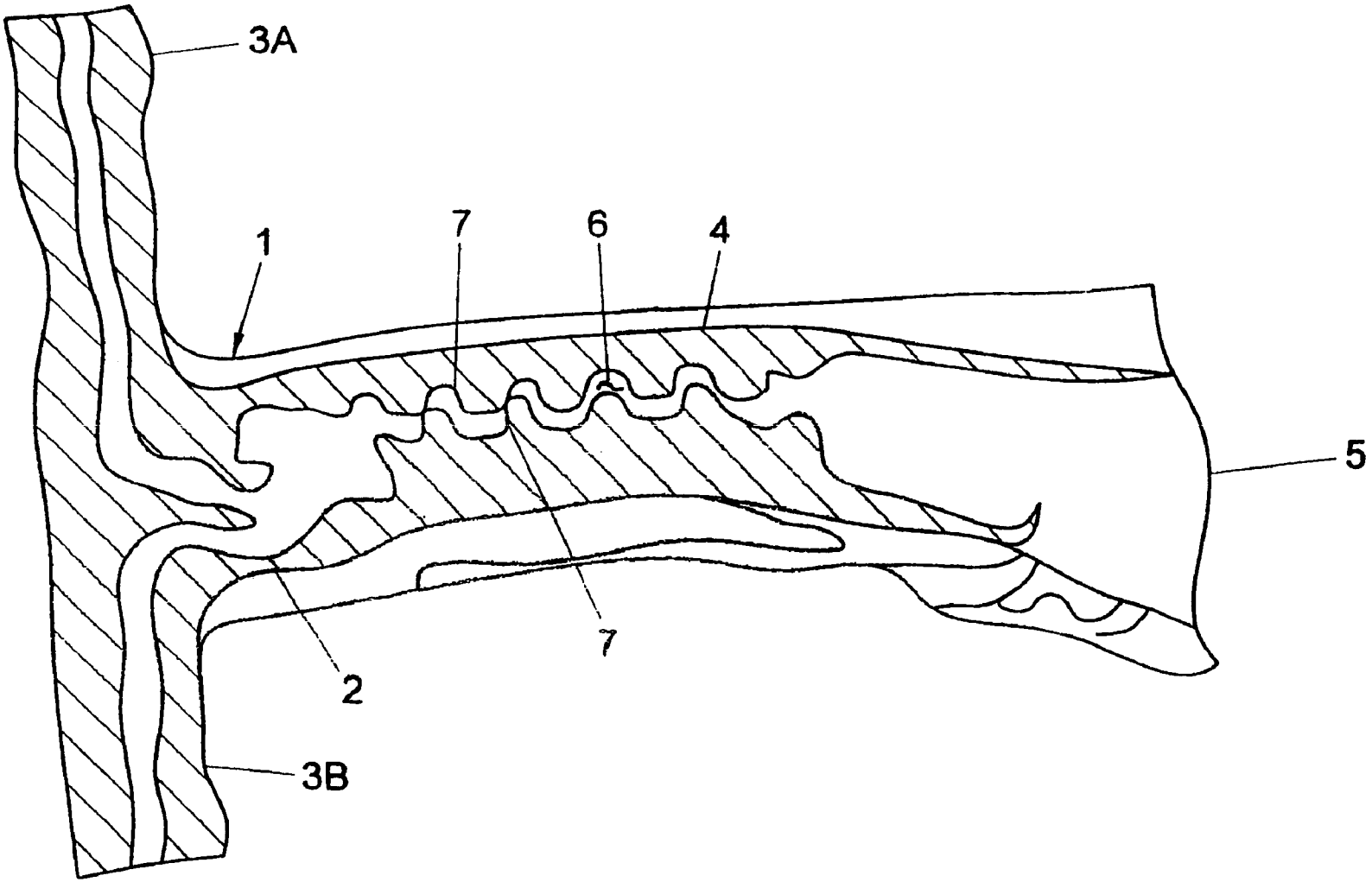
FIG. 1 is a schematic illustration of the uterus of a pig.

FIG. 1 shows schematically the anatomical configuration of the uterus of a pig. The uterus 1 comprises a uterus body 2, a pair of horn-like extensions 3A, 3B, extending from the uterus body 2, and a cervix 4 connecting the vagina 5 of the pig to the uterus body 2. The inside walls defining the cervical canal 6 of the cervix are convoluted and lined with rounded prominences 7, some of which interconnect to occlude the canal 6.

An assembly and method according to the present invention are illustrated with respect to the non-surgical transplant of fluid comprising, for example, semen or especially embryos into the uterus of a pig. However, it will be understood that the same assembly and method can be used to carry out artificial insemination, non-surgical transfers and similar non-surgical methods of transfer of other fluids and material in porcine, bovine and other species.

Figure 2:
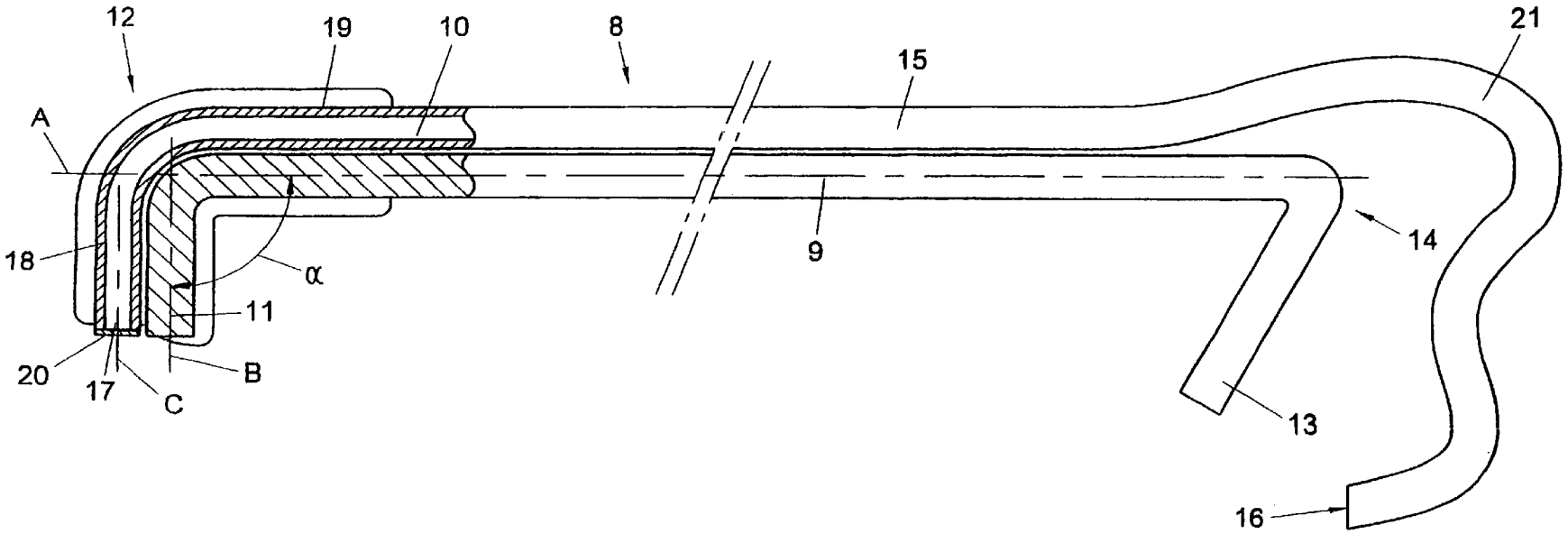
FIG. 2 is a side view of a probe according to the present invention, partly broken away, in a first embodiment.
Figure 4:
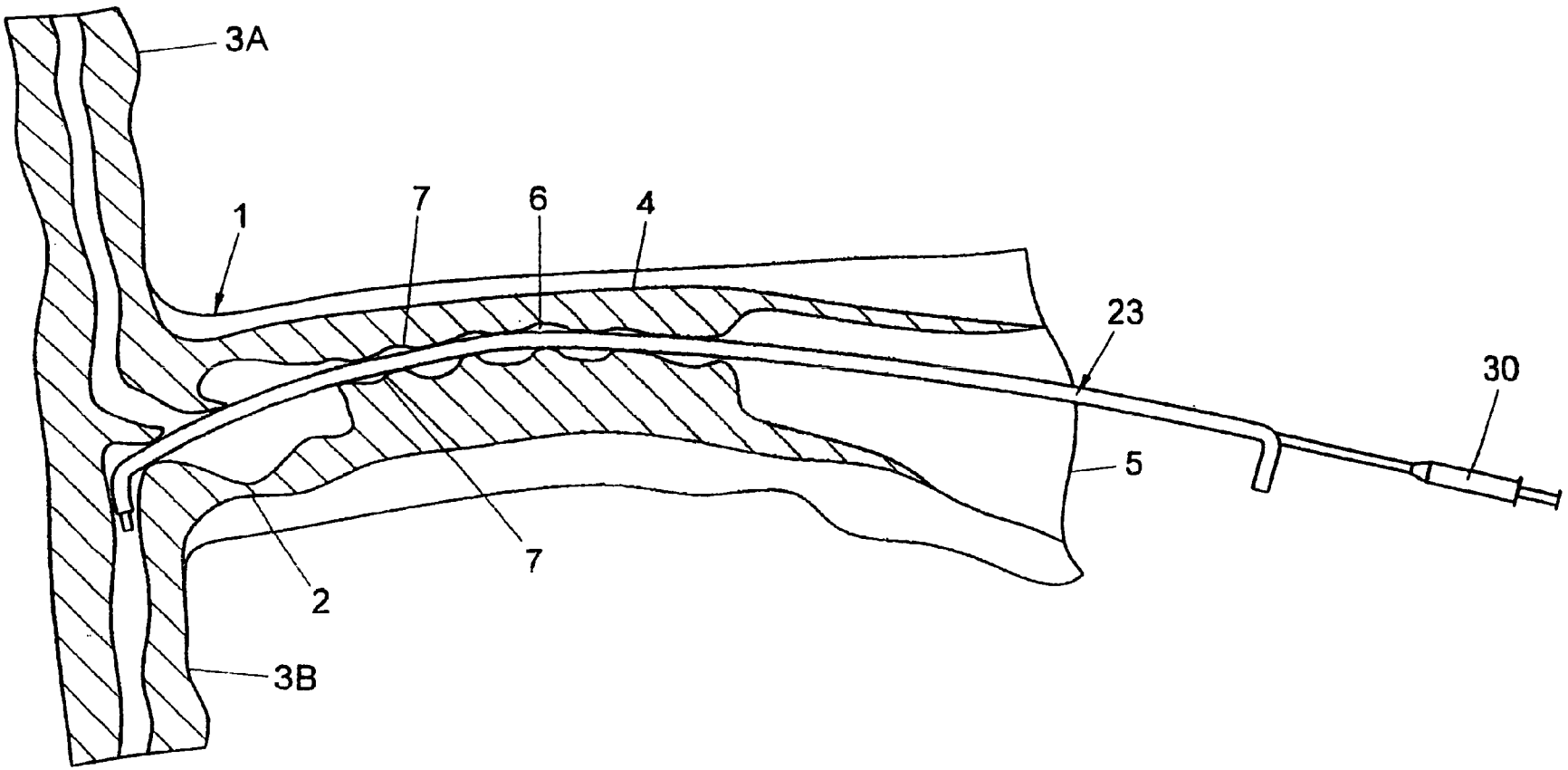
FIG. 4 is a side view of an assembly according to the present invention, introduced into the uterus of a pig.

FIG. 2 shows a first embodiment of a probe 8 according to the present invention, the probe 8 comprising a probe body 9 and a channel 10. The probe body 9 is relatively long and has a longitudinal axis A, a probing member 11 extending at least laterally outward at the forward end 12 of the probe body and a gripping means 13 extending from the opposite rearward end 14 of the probe body 9. In the shown embodiment, the probe body 9, the probing member 11 and the gripping means 13 are made by bending a plastic rod into the desired shape, for example, a PVC rod. The longitudinal axis B of the probing member 11 encloses an angle $\alpha$ with the longitudinal axis A of the probe body, which angle $\alpha$ in the shown embodiment is approximately 90° . However, the angle $\alpha$ can also be a sharp or blunt angle, for example, between 45° and 135° , preferably between 60° and 120°. The length of the probing member 11 and the enclosed angle $\alpha$ can be chosen such that by manipulating the probe body, the probing member 11 can be introduced in between and manuevered past the prominences 7 of the canal 6 of the cervix 4, as will be explained hereafter. The gripping means 13 comprises the bent rearward end 14 of the probe body 9. The probing member 11 and the gripping means 13 are preferably positioned in the same plane when the probe 8 is in its initial position. This has the advantage that the position of the gripping means 13 provides for a direct indication of the position of the probing member 11 when introduced into the uterus 1. The length of the probe body 9 is at least such that when the probing member 11 is positioned in or adjacent to the uterus body 2 or one of the horn-like extensions 3A, 3B, the rearward end 14 of the probe 8 extends well outside the vagina 5, as is shown in FIG. 4. Thus, the probe 8, especially the probing member 11, can be manipulated within the uterus body 2 by manipulation of the gripping means 13, which extends well outside the uterus.

The channel 10 is provided for by a tube 15, preferably made of a flexible material such as plastic, silicone, rubber or the like, positioned alongside at least a substantial part of the probe body 9 and the probing member 11. The channel 10 comprises an inlet opening 16 near the rearward end 14 of the probe 8 and an outlet opening 17 near the free end of the probing member 11, that is, near the forward end 12 of the probe 8. Since the part 18 of the tube 15 near the outlet opening 17 extends alongside the probing member 11, the central axis C of the part 18 extends at least approximately parallel to the longitudinal axis B of the probing member 11, enclosing approximately the angle $\alpha$ with the longitudinal axis A of the probe body 9. The forward end of the tube 15 and the forward end 12 of the probe body 9 are embedded in a casing 19 made preferably of a relatively soft, flexible material, such as elastomer, silicone, rubber or the like, to connect the forward end of the tube 15 to the probe body 9 and probing member 11 and may also protect the inside walls of the uterus 1 and cervix 4. The outlet opening 17 is positioned approximately adjacent the free end of the probing member 11, and is closed by a membrane 20, which is pierceable or which can be pushed away, as will be explained later. The membrane 20 prevents contamination of the inside of the channel 10 during manipulation of the probe through the vagina into the cervix and uterus body 2.

The tube 15, and thus the channel 10, preferably has a length which is substantially greater than the length of the probe body 9, whereby the flexible rearward part 21 is free from the probe body 9. Thus, the inlet opening 16 of the channel 10 is easily accessible, for example, from an angle different from the longitudinal axis A of the probe body 9 when introduced into the uterus 1.

Figure 5:
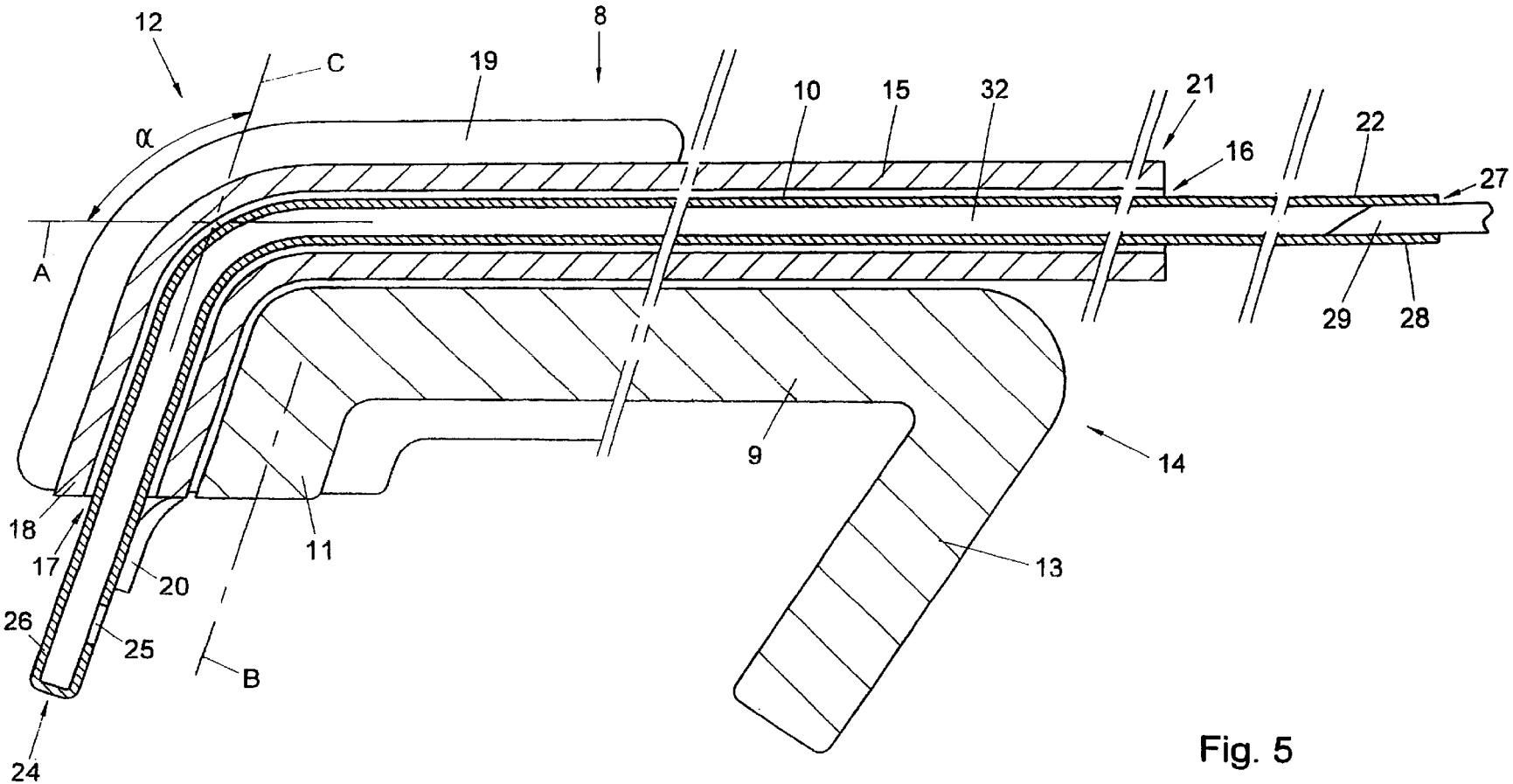
FIG. 5 is an enlarged side view of an assembly according to the present invention, in cross-section, on an enlarged scale.

In FIG. 5, an assembly according to the present invention is shown, in an enlarged scale, comprising a probe 8 according to FIG. 2, through which a tubular element 21 is introduced, as will be explained hereafter.

The probe 8 is covered, with at least its forward part to be introduced into the uterus, by a thin, flexible sheet, for example, a plastic foil, which can be tubular (not shown). Then, the forward end 12 of the probe 8 is introduced through the vagina into the cervix, until the probing member 11 abuts one of the prominences 7 at the entrance of the canal 6. Then, if necessary, the probe 8 is rotated, preferably in a reciprocal manner, mainly around its longitudinal axis A, by manipulation of the gripping means 13, such that the probing member 11 is gently urged in between the prominences 7, thereby partly moving the prominences 7 apart and partly flexing the probe body 9. The protective sheet can be pulled away over the probe body 9. Thus, the forward end 12 of the probe can be gently urged forward past the prominences 7, at least partly following the bends and curves of the cervix 4, as is shown in FIG. 4. Once the forward end 12, that is, the probing member 11, has been pushed past the prominences 7 of the cervix 4, the forward end 12 of the probe 8 can be introduced into the uterus body 2, until the probing member 11 is positioned near one of the horn-like extensions 3A, 3B. An indication 23 has been provided on the probe body 9, for example, a coloring, at a distance from the probing member 11 corresponding to the average length of the uterus body, cervix and vagina of the relevant animal taken together. Furthermore, the resistance of the inside wall of the uterus body in comparison to the resistance of the cervical canal will provide an indication of the position of the probing member 11 within the uterus body 2.

When the probe 8 is brought into the position as shown in FIG. 4, the tip 24 of the tubular member 22 is slidably introduced into the inlet opening 16 of the channel 10 within the tube 15. The forward end of the tip 24 is closed, whereby an outlet opening 25 is provided in the wall 26 of the tubular member 22, at a relatively short distance from the tip 24. The tubular member 22 further comprises an inlet opening 27 at the tail 28, that is, the opposite rearward end of the tubular member 22, in which, for example, the needle 29 of, for example, a syringe 30 has been introduced. The tip 24 of the tubular member 22 is pushed forward through the channel 10 until the tip 24 abuts the membrane 20. By forcing the tip 24 forward, the membrane 20 will be pierced or pushed aside, after which the outlet opening 25 will be pushed past the outlet opening 17 of the channel 10, the tip 24 extending freely within the uterus body 2 or one of the horn-like extensions 3A, 3B thereof. Then a fluid, containing, for example, semen or embryos, to be introduced into the uterus 1 is introduced from the syringe 30, through the channel 32 of the tubular member 22 and out the outlet opening 25 into the uterus body 2 or horn-like extension 3B. Since the tubular member 22 is fully guided by the channel 10, that is, the tube 15, folding of the tubular member 22 or any other occlusion thereof is prevented. Therefore, a proper introduction of the fluid into the uterus body 2 or horn-like extension 3B is guaranteed.

Depending on, for example, the form and position of the horn-like extensions 3A, 3B and the uterus body 2 and cervix 4 relative to each other, the length of the probe body 9, the enclosed angle $\alpha$ between the longitudinal axes A and B, the angle enclosed between the longitudinal axis A and central axis C and the flexibility of at least the probe body 9 can be chosen appropriately. By way of example, which should by no means be understood as limiting the scope of the present invention, dimensions are given for an assembly according to the present invention, convenient to be used for introduction into the uterus of a pig. The probe body can have an overall length of approximately 950 mm, with a circular cross-section having a diameter of 3 mm. A first indicator is positioned at approximately 115 mm, and a second indicator at approximately 310 mm from the rearward end 14. The enclosed angle $\alpha$ is approximately 110°, and the length of the probing member 11 approximately 10 mm. The tube 15 has an inside diameter of 1.5 mm, and the tubular member 22 an inside diameter of approximately 0.7 mm. The excess length of the tube 15 is, for example, 170 mm over the length of the probe body 9, and the excess length of the tubular member 22 over the tube 15, for example, is 350 mm. The distance between the tip 24 and the outlet opening 25 of the tubular member 22 will be approximately 5 mm. The modulus of elasticity of the probe body, which is made of PVC, is preferably just under 3000 N/mm$^2$. An appropriate choice of dimensions and materials to be used will nevertheless be sufficiently clear to the person skilled in the art.

Figure 3:
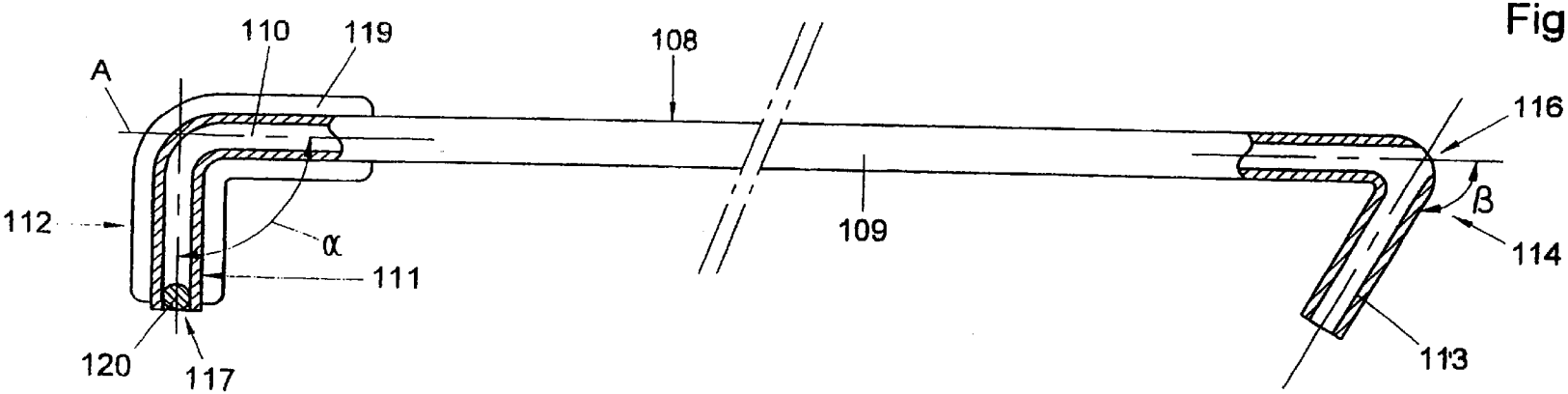
FIG. 3 is a side view of a probe according to the present invention, partly broken away, in a second embodiment.

FIG. 3 shows an alternative embodiment of a probe 108 according to the present invention, made of a single, bent, tube-like probe body 109. The probe body 109 is, for example, made of plastic, such as PVC, PE, PA, silicone or any other suitable material. The forward end 112 of the probe body 109 has been bent over an angle α, again for example 90°, for forming the probing member 111. The forward end 112 might be embedded in a soft casing 119, as discussed before. The rearward end 114 of the tube-like probe body 109 has been bent over an angle β for forming the gripping means 113. The gripping means 113 and the probing member 111 are once again positioned in the same plane. Through the probing member 111 and the probe body 109 extends the channel 110. In the rearward end 114 of the probe 108, an inlet opening 116 has been provided, preferably such that the longitudinal axis A of the probe body 109 extends through the inlet opening 116. Within the outlet opening 117 of the channel 110, within the probing member 111, a stop 120 has been provided for temporarily closing the outlet opening 117, thus prohibiting contamination of the inside of the channel 110. Once again, the probe body 109 is sufficiently flexible to at least partly follow bends, curves and prominences of the cervix and/or uterus body of a uterus 1 of an animal.

During use, the probe 108 can be brought into position as shown in FIG. 4 in a manner similar to the one as described with reference to the embodiments shown in FIG. 2. Then, the tip of a tubular member 122 (not shown), similar to the tubular member 22 as shown in FIG. 5, can be introduced through the inlet opening 116 into the channel 110 and can then be pushed forward until the tip thereof is in abutment with the stop 120. The stop 120 can then be pushed out of the outlet opening 117, thus enabling the tip, especially the outlet opening 125 (not shown) of the tubular member 122 to be urged into the uterus body or horn-like extension of the relevant uterus. Then, an appropriate fluid can be introduced from a syringe into the uterus as described hereinbefore. Such stop 120 is preferably attached to the assembly to enable retraction thereof with the assembly.

Figure 6:
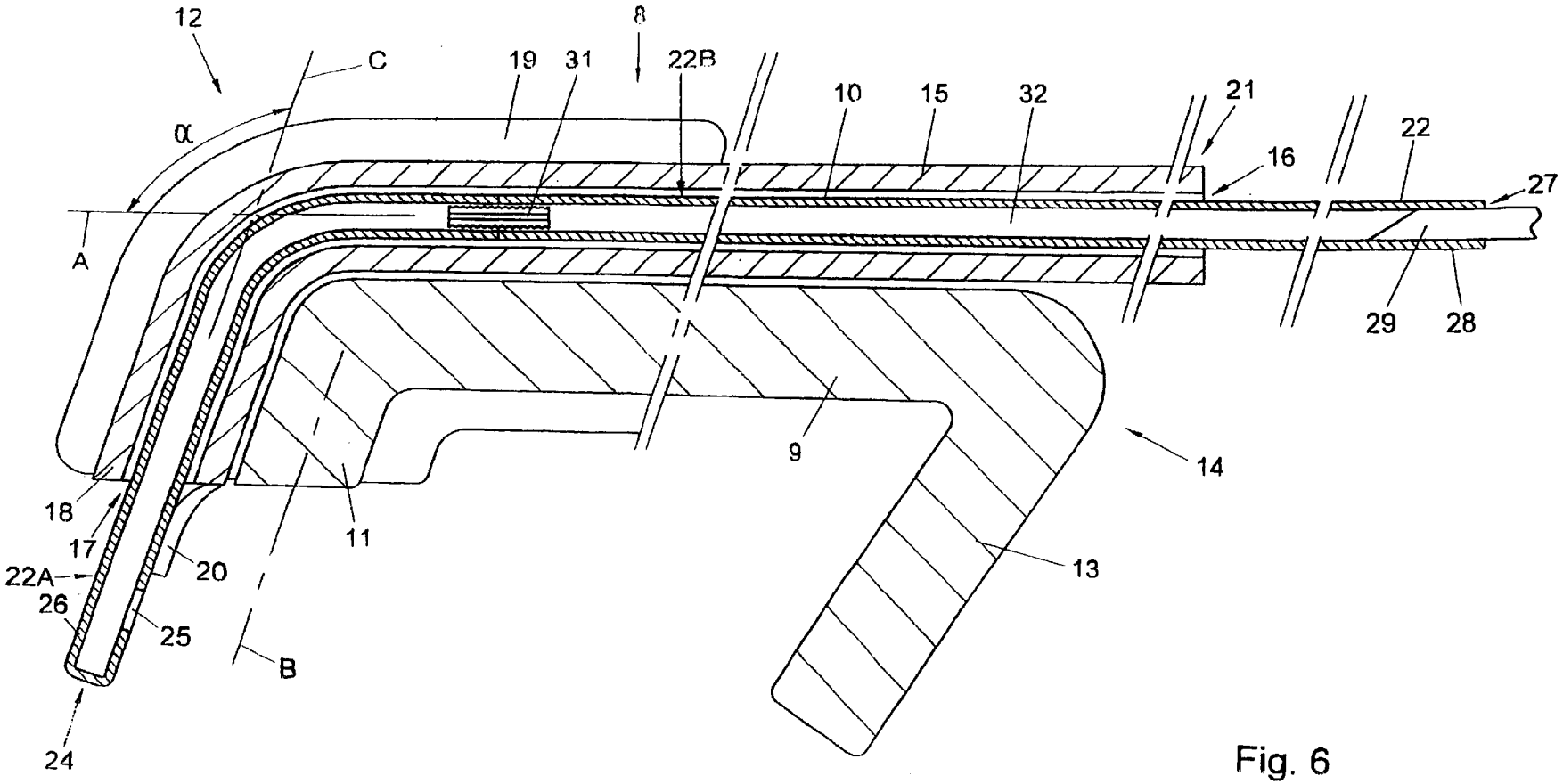
FIG. 6 is a further embodiment of an assembly according to the present invention.
Figure 7:
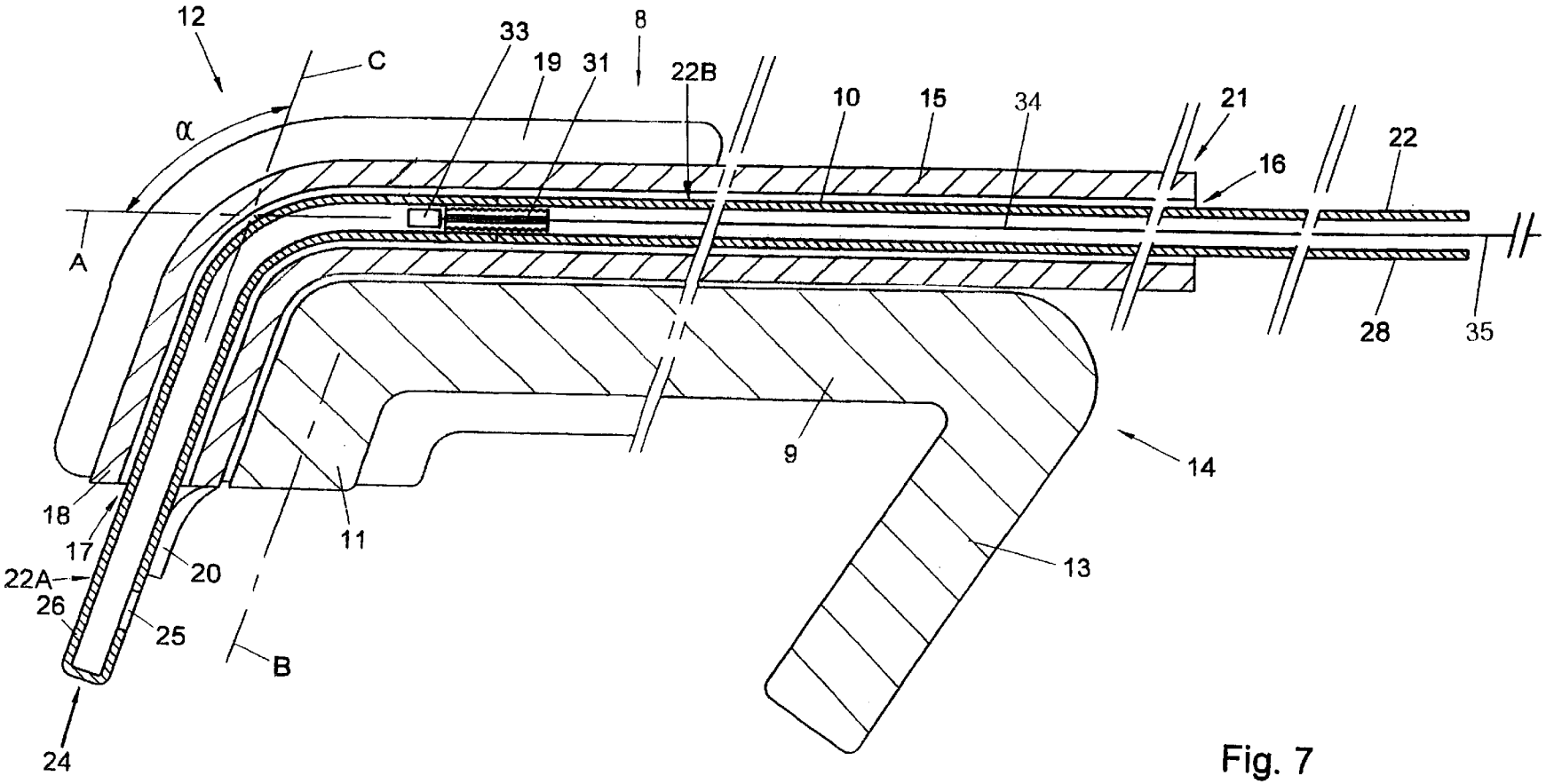
FIG. 7 is a still further embodiment of an assembly according to the invention.

FIG. 6 shows a further alternative embodiment of an apparatus according to the invention, similar to the assembly according to FIG. 5. In this assembly according to FIG. 6, the tubular member 22 is divided in a relatively short first part 22A, comprising the tip 24 and the outlet opening 25. This first, relatively short part is connected to a second part 22B with a relatively great length through a hollow connecting element 31, forming a fluidum connection between the first and second parts 22A, 22B. This assembly can be used as follows. The semen or embryos to be introduced through the outlet opening 25 into the cervix are enclosed within the first part 22A, in which they can be transported and stored. To this end, the connecting member 31 can be replaced by a stopper element (not shown). Directly before use, the stopper element is removed and the first part 22A is connected to the second part 22B through the connecting element 31, after which the tubular member 22 is brought into position for introduction of the embryos (or semen) through the outlet opening by the syringe 30. In an embodiment as shown in FIG. 7, the stopper element 33 is connected to a rod or wire 34 sufficiently flexible to follow bends and curves in the tubular member 22 and sufficiently rigid to push the stopper element 33 through at least the first part 22A of the tubular member 22, which wire 34 extends through the second part 22B of the tubular member 22, such that the free end 35 thereof extends outside the tubular member 22. By this wire 34, the stopper element 33 can be pushed forward, such that the embryos or semen are forced out through the opening 25. The wire 34 can be fixed to the stopper 33 or positioned free in the tubular member 22. An assembly according to FIGS. 2 and 3 can be amended in a similar way. Such assembly has the advantage that storage and transport of the semen or embryos is easy, as is handling thereof.

As can be understood from the description and the drawings, the outlet opening 25, 125 of the tubular member 22, 122 can be brought into a position with minimal pressure of the inside wall of the uterus very easily, even though the forward end of the probe assembly cannot be seen by the person manipulating the probe assembly. Thus, a proper delivery of the fluid into the uterus body is guaranteed. It will be directly clear that the fluid could also be introduced into the uterus body directly through the channel 10, 110 without the use of the tubular member 22, 122, as long as the outlet opening 25, 125 is open or opened before or upon introduction.

A flexible assembly according to the present invention has the advantage that it can be introduced into the vagina, cervix and uterus of an animal, even if it is not sedated. Therefore, a method according to the present invention can be performed without the necessity of assistance by a veterinarian or surgeon or the like. Especially with introduction of embryos, an assembly according to the present invention is advantageous since a very high rate of success can be obtained with a normal number of embryos necessary. For example, with an assembly according to the present invention, about thirty well-developed embryos were brought into the uterus of pigs, which resulted in pregnancy for approximately 60% of the pigs, or an average carrying about 9 to 10 embryos on the thirty-fifth day of their pregnancy. This is, for this moment, a high rate of success, especially for a non-surgical method.

Within the scope of the present invention a number of variations on the embodiments shown and described hereinbefore are possible.

For example, the probe body and tube, as shown in FIG. 2, could be produced as one single part, having, for example, an approximately oval or FIG. 8 like cross-section, the channel being positioned off center. Furthermore, the gripping means could be dispensed of or could be provided for in a different manner, for example, as a knob-like element attached to the probe body. If so desired, the outlet opening 25, 125 of the tubular member 22, 122 could be positioned in a different place, for example, in the end face of the tubular member, whereas also a number of spaced-apart outlet openings could be provided for, thus even better ensuring at least one free outlet opening during use. Furthermore, the probe body could, for example, be curved in an unstressed, initial position, the curve being comparable to the possible curvature of the cervix of the relevant animal. A probe or probe assembly according to the present invention can be of a reusable type but is preferably of a dispensable type. Instead of using a syringe for introduction of relevant material such as semen or embryos into the uterus, it is also possible to introduce such material into the tubular member 22, 122 through the outlet opening 25, 125 prior to introduction of the tip into the channel, whereby the material can be introduced into the uterus body or horn-like extensions thereafter by using a syringe, forcing a fluid through the tubular member, thus pushing the material, contained in the tip of the tubular member, out through the outlet opening. Thus, only a limited volume of fluid has to be introduced into the uterus. Furthermore, the material could be brought into the channel or tubular member by different means, for example, by using a pump or the like.

The probe body can be partly relatively rigid and partly relatively flexible, due to a choice of material and/or construction.

Those and similar variations are considered to fall within the scope of the present invention.

What is claimed is:

1. An assembly for penetrating a uterus of a mammal, said assembly comprising:

a probe comprising an elongate body having a longitudinal axis, a forward end, and a rearward end, and a probing member extending laterally away from said longitudinal axis of said elongate body at the forward end of said elongate body, said elongate body being sufficiently flexible to enable said probe to be introduced into a cervix and uterus of an unsedated mammal; and a channel comprising an inlet located toward said rearward end of said elongate body, an outlet located near said probing member, and an enclosed space extending between said inlet and said outlet, said channel further including a bend such that the channel forms an angle of less than 180° with said longitudinal axis of said elongate body near said outlet.

2. The assembly of claim 1, further comprising a tubular member that is insertable within and displaceable through said channel, said tubular member being longer than said channel and having an inlet opening and an outlet opening.

3. The assembly of claim 2, wherein the tubular member further comprises a sealed front end and a sidewall, and said outlet opening the tubular member is provided in said sidewall.

4. The assembly of claim 1, wherein said angle of less than 180° comprises and angle between 45° and 135°.

5. The assembly of claim 4, wherein said angle of less than 180° comprises an angle of between 60° and 120°.

6. The assembly of claim 1, wherein at least a portion of said channel near the outlet follows a longitudinal axis parallel to a longitudinal axis of the probing member.

7. The assembly of claim 1, wherein said channel comprises a tube extending along at least part of the elongate body of the probe and along at least part of the probing member.

8. The assembly of claim 1, wherein the elongate body of said probe has a cross-sectional height of less than 5 mm, a cross-sectional width of less than 5 mm, and a Modulus of Elasticity of less than 6000 $N/mm^2$.

9. The assembly of claim 8, wherein said elongate body of said probe comprises an elongate body having a circular cross section measuring approximately 3 mm in diameter and possessing a modulus of elasticity of approximately 3000 $N/mm^2$.

10. The assembly of claim 1, further comprising a membrane disposed across said outlet of said channel.

11. The assembly of claim 1, wherein the elongate body of the probe further comprises a handle near the rearward end thereof.

12. The assembly of claim 1, wherein the elongate body of said probe comprises plastic.

13. A method for introduction of material into a uterus of a mammal, the method comprising:

providing a probe assembly comprising:

a probe adapted to be inserted inside a cervix of said mammal, said probe comprising an elongate body having a longitudinal axis, a forward end, and a rearward end, and a probing member extending laterally away from said longitudinal axis of said elongate body at the forward end of said elongate body, said elongate body being sufficiently flexible to enable said probe to be introduced into a cervix and uterus of an unsedated mammal;

a channel comprising an inlet located toward said rearward end of said elongate body, an outlet located near said probing member, and an enclosed space extending between said inlet and said outlet, said channel further including a bend such that the channel forms an angle of less than 180° with said longitudinal axis of said elongate body near said outlet; and a tubular member that may be inserted within and displaced through said channel, said tubular member being longer than said channel and having an inlet opening, an outlet opening, a front end, and a back end;

inserting a portion of the probe assembly into the cervix of said mammal;

pushing the probing member and a portion of the elongate body of the probe forward through the cervix by rotating the elongate body generally around the longitudinal axis;

inserting the tubular member into the inlet of the channel such that the front end of the tubular member extends outside the outlet of the channel; and introducing the material into the uterus through the outlet opening of the tubular member.

14. The method according to claim 13, wherein inserting the tubular member into the inlet of the channel comprises inserting said tubular member through a bend or curve in the channel, such that the front end of said tubular member extends into the uterus of the mammal at an angle less than 180° relative to the longitudinal axis of the elongate body of the probe.

15. The method according to claim 14, wherein providing a probe assembly comprises providing a probe assembly further comprising a sealing device occluding the outlet of said channel, and inserting the tubular member into the inlet of the channel comprises inserting the tubular member into the inlet such that the front end of the tubular member is pushed beyond the sealing device occluding the outlet of the channel and into the uterus of said mammal.

16. The method according to claim 15, wherein providing a probe assembly comprises providing a probe assembly further comprising a removable sleeve at least partly surrounding the elongate body of the probe.

17. The method according to claim 13, wherein providing a probe assembly comprises providing a probe assembly further comprising a sealing device occluding the outlet of said channel, and inserting the tubular member into the inlet of the channel comprises inserting the tubular member into the inlet such that the front end of the tubular member is pushed beyond the sealing device occluding the outlet of the channel and into the uterus of said mammal.

18. The method according to claim 17, wherein providing a probe assembly comprises providing a probe assembly further comprising a removable sleeve at least partly surrounding the elongate body of the probe.

19. The method according to claim 18, wherein providing a probe assembly further comprising a removable sleeve at least partly surrounding the elongate body of the probe comprises providing a removable sleeve made of thin, flexible foil.

20. The method according to claim 13, wherein introducing the material into the uterus through the outlet opening of the tubular member comprises introducing at least one embryo into the uterus.

* * * * *

UNITED STATES PATENT AND TRADEMARK OFFICE

CERTIFICATE OF CORRECTION

PATENT NO. : 6,607,518 B1
DATED : August 19, 2003
INVENTOR(S) : Wouter Hazeleger It is certified that error appears in the above-identified patent and that said Letters Patent is hereby corrected as shown below:

Column 1,
Line 19, change “Invention” to -- The invention --

Column 2,
Line 38, insert a period after “thereof”

Column 4,
Line 1, before “success” insert -- of --

Column 8,
Line 40, change “8 like” to -- 8-like --

Signed and Sealed this

Ninth Day of December, 2003

JAMES E. ROGAN
*Director of the United States Patent and Trademark Office*